United States Patent [19]

Hirsch

[11] 4,269,441

[45] May 26, 1981

[54] TRASH BAG HOLDER

[76] Inventor: Henry M. Hirsch, 104 Wilderness Rd., Rancho Cordova, Calif. 95670

[21] Appl. No.: 107,188

[22] Filed: Dec. 26, 1979

[51] Int. Cl.[3] ..... A47F 13/06

[52] U.S. Cl. ..... 294/1 R; 294/55

[58] Field of Search ..... 294/55, 19 R, 1 R, 93, 294/97, 99 R; 15/104.8, 257.1, 257.4, 257.7, 257.8; 248/95, 97, 99, 100, 101; 53/390, 392; 150/49; 56/400.13, 400.11

[56] References Cited

U.S. PATENT DOCUMENTS

| | | | |
|---|---|---|---|
| 3,754,785 | 8/1973 | Anderson | 294/19 R |
| 3,936,087 | 2/1976 | Alexander | 294/1 R |

*Primary Examiner*—James B. Marbert

*Attorney, Agent, or Firm*—Mark C. Jacobs

[57] ABSTRACT

This invention pertains to a novel trash bag holder comprising a bag retaining frame and a handle means that mounts on the frame after the bag has been inserted on the frame. The device is low in cost, and is intended to permit the sweeping of leaves and other debris into a trash bag without the necessity of bending or lifting which can be quite difficult for older people.

7 Claims, 5 Drawing Figures

TRASH BAG HOLDER

BACKGROUND OF THE INVENTION

There are many different types of trashcans on the market which can be tilted over 90° to come to the ground. Thoses that are round present only a minimum of surface area to the ground for the inward sweeping of leaves and other debris. Those that are square are usually configured such that the lip does not fit flush to the ground, thus rendering collection often difficult. Reference is made to the products sold by Sears Roebuck for instance. The problem exists because corrugaation has been built into the sidewall of such trash containers for strength.

Trash bag holders are also known to the art. The ones known to the applicant, are rigid frames or stands which are intended to hold the bag vertically such that debris can deposited therein by a downward motion into the bag. Such bag holders are intended for holding twigs, sticks, leaves etc. in the bags, all of which items must be lifted up from the ground to the elevation of the top of the bag for deposit. It is the bending and lifting motion that the invention of this application is intended to alleviate.

It is an object therefore to provide a trash bag holder that permits the bag to be oriented 90° such that leaves, dirt and the like can be swept directly into an open bag without the necessity of bending down to either push the material into the bag or to pick up the waste products for deposition.

It is another object to provide a low cost trash bag holder readily utilizeable by senior citizens.

It is yet another object to provide a trash bag holder that is low in price and easy to manufacture.

Still another object is to provide a trash bag holder that securely holds a trash bag until it is desired to discard same.

Other objects of the invention will in part be obvious and will in part appear hereinafter.

The invention accordingly comprises the product possessing the features, properties and the relation of components which are exemplified in the following detailed disclosure and the scope of the application of which will be indicated in the appended claims.

SUMMARY OF THE INVENTION

The invention comprises a frame for retaining a plastic film trash bag and a slideably mounted handle means that fits on the frame upon which the bag has been inserted to securely hold the bag on the frame.

For a fuller understanding of the nature and objects of the invention, reference should be had to the following detailed description taken in conjunction with the accompanying drawings.

DESCRIPTION OF THE PREFERRED EMBODIMENT

Figure 1:
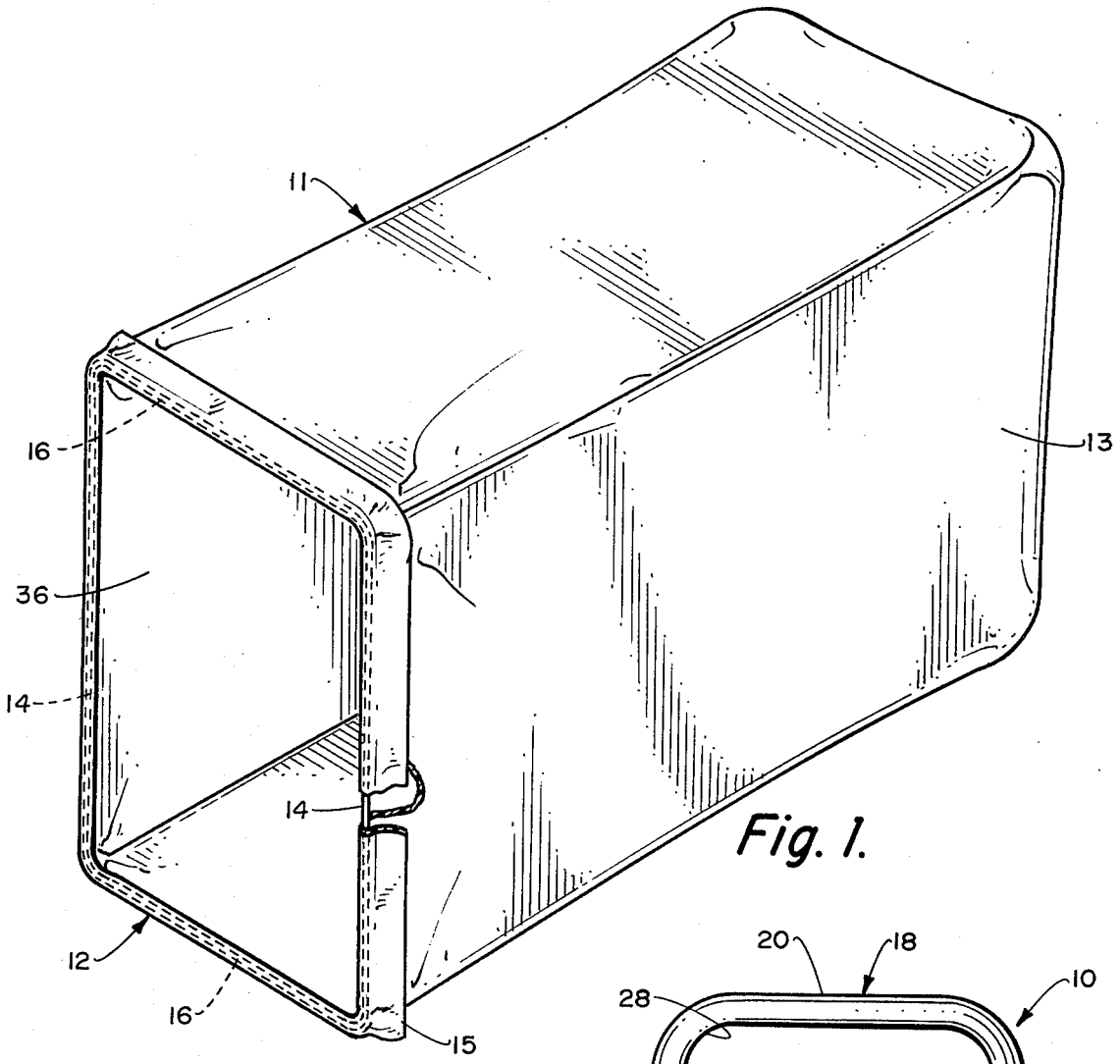
FIG. 1 is a perspective view showing a trash bag inserted into the frame part of this invention which is a trash bag holder.

The invention of the instant application designated device 10, comprises two parts, a frame and a handle means. Frame 12 is a generally rectangular continuous rod or wire made of metal such as steel or aluminum alloy; or of an extrudeable plastic such as polyvinyl chloride or ABS, acrylonitrile-butadiene-styrene. Frame 12 consists of two spaced apart longer sections 14, and two spaced apart shorter sections 16 normal thereto and opposed to each other. Reference is made to FIG. 1. Frame 12 may be made of ⅛ inch wire or rod as is used in clothes hangers. For plastic materials, it is believed that 0.25 inch stock would be required to give adequate strength to the frame for rigidity. Frame 12 can be made from one continuous extrusion that is bent at right angles and suitably attached at the ends thereof as by heat or solvent for plastic or by welding in the case of metal. The manufacture of such frame 12 is well within the skill of the art. Preferably the corners should be slightly curved to allow for easy attachment and detachment of plastic film bags 11.

Trash bags 11, are usually of a volume quoted as 30 to 33 gallons, which relates their capacity to standard household trash cans. Such bags are readily available in the marketplace from such manufactures as Mobil Chemical and Dow Chemical among others. Bag 11 is seen to consist of two portions, the main body 13, and the top 4 to 6 inches, 15, designated as the flap which fits over frame 12. To mount bag 11, the top or flap section 15 is inserted through the inside of the frame 36, (a space); and bent over the frame and down again such as to be doubled back on itself. See FIG. 1.

Frame 12 as is seen is a rigid structure formed of relatively slender pieces joined so as to surround a sizeable empty space. Frame 12 can be either multi-pieced or one continuous piece bent, and joined as discussed above.

Figure 3:
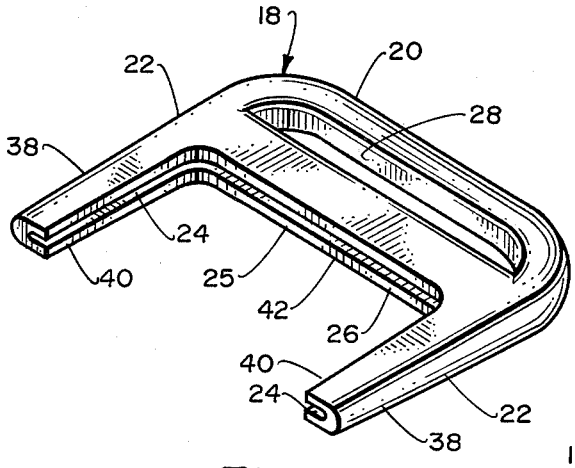
FIG. 3 is a bottom perspective view of the handle means of the invention
Figure 2:
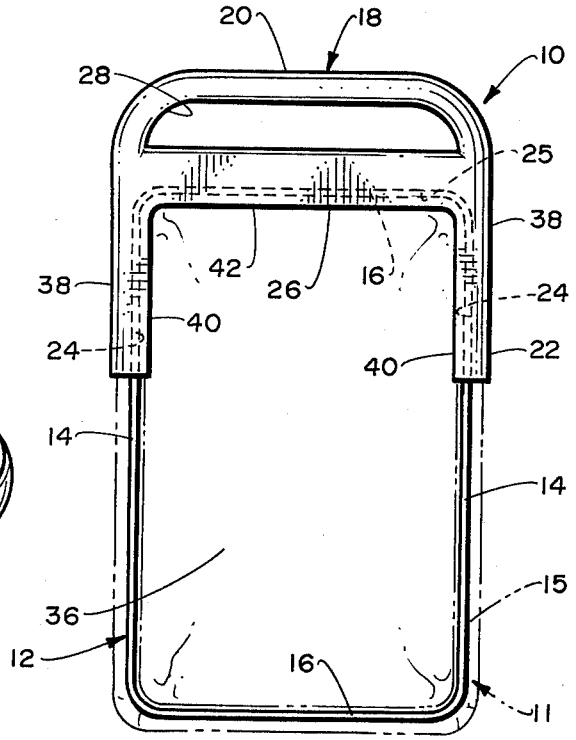
FIG. 2 is a front elevational view showing a trash bag mounted on the frame with the handle means part of the invention mounted over the frame with the trashbag therebetween.

Handle means 18, comprises a handle portion 20 having a finger opening 28 extending horizontally therethrough. Depending downwardly, and parallel from the bottom wall 26 of said handle portion's outer edges 38 are a pair of frame receivers, 22. These receivers have a groove 24 on the inside surface 40, said groove 24 extending the length of said inside surface 40. While shown in the figures to be rectangular in shape, frame receivers 22 could also be round or triangular if desired. Each groove 24 terminates at and communicates with groove 25 on the underside of wall 26 to form a generally inverted U-shaped channel 42 sized to receive and retain frame 12 therein. To achieve same, it is preferred that the configuration be circular with the opening into the groove being less than the diameter of the circle. Thus under pressure, the frame can be inserted and withdrawn at will from the handle means. Obviously, the frame should be of a compatible cross-section to achieve this desired result. Reference is made to FIGS. 2 and 3.

Figure 4:
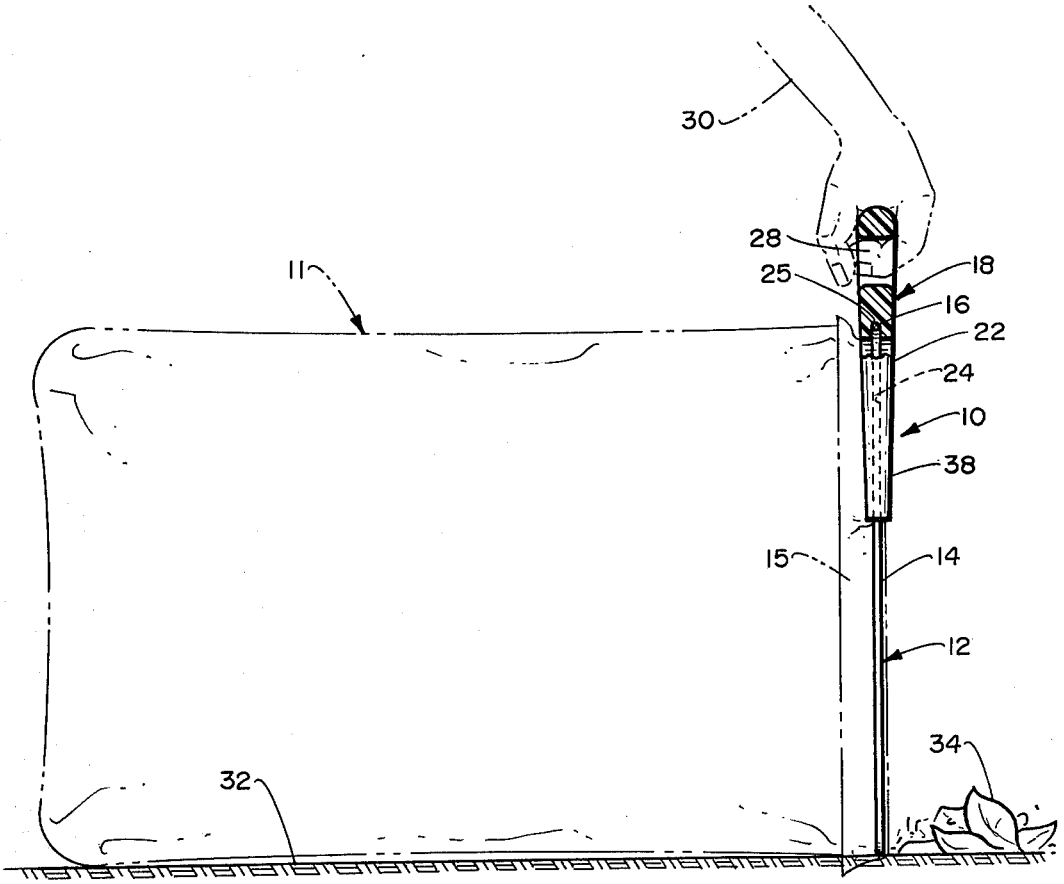
FIG. 4 is a side elevational view showing the device of this invention being employed as intended.

FIG. 4 shows the invention of this application in use. First a bag 11 is inserted thru opening 36 and the flap portion 15 is wrapped down over the frame 12. The frame receivers 22 are first snapped over the frame 12 such that long sections 14 are within the groove 24; then while holding the frame and bag with one hand, the handle means 18 is slid down onto the frame 12's long sides 14. Then with a slight urging, groove 25 is snapped onto one of the short sections 16 such that the frame is held rigidly in place, but yet can be removed from the handle means when the bag 11 is filled with debris.

In FIG. 4 fingers 30 are seen to be inserted in the finger opening 28. The bag is seen mounted on the device 10 ready to receive the leaves and other debris 34 found on the ground 32. The debris 34 is easily swept in with a broom, not seen, for disposal.

It has been found that with the 30 gallon bag 11 that dimensions for frame 12 should be about 12" by 18.5" for an acceptable fit. It has also been found that the flap 15 will be less likely to slip from the frame if the surface of frame 12 is roughened. One material found to give satisfactory results is sheradised wire.

While the frame receivers can be slidingly engaged to the frame pieces, along the entire length of the grooves, 24, to secure the handle means 18 to the frame 12, it is recommended that the frame receivers be spread apart slightly and the frame long sections 14 be snapped into place in groove 24, and then be slid down in said groove until engagement with groove 25 is achieved. This is easily accomplished as the plastic material to be used for handle means 18 will have some flexibility.

Figure 5:
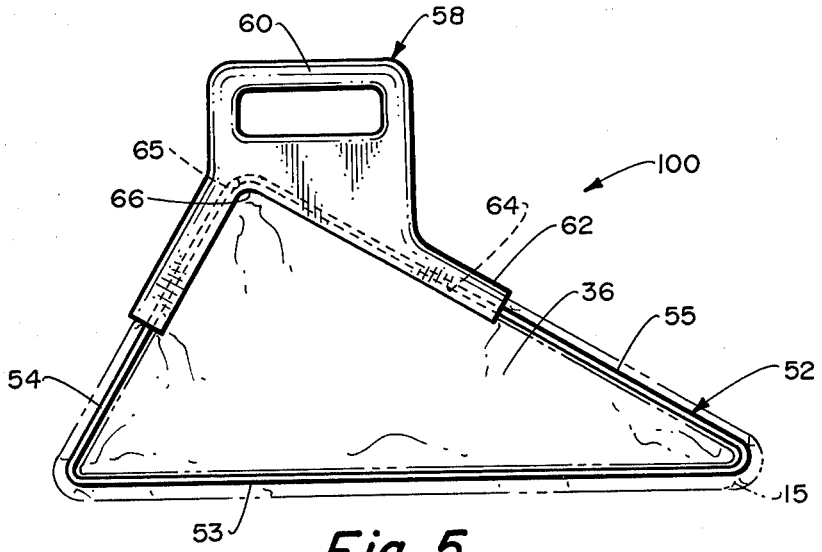
FIG. 5 is a front elevational view of a second embodiment of the trash bag holder of this invention.

It has also been found that with certain bags that are substantially wider in comparision to their depth, that better results are obtained as far as ease of handling, if a triangular frame such as 52 as shown in FIG. 5 is employed. Such a frame is shaped like a right angle triangle, with its hypotenuse 53, a short side 54 and a long side 55. For use with such a frame 52, a handle means 58 is employed which has two divergent frame receivers appended to a handle portion 60. These frame receivers 62 each have a groove 64 on the inner surface thereof similar to their vertical counterparts discussed above. Since the right angle of the frame 52 is slightly arcuate, for ease of manufacture, and to avoid sharp corners, there is necessitated a small bottom surface 66 of handle portion 60 which will also have a groove 65 therein which will communicate with groove 64 of the frame receivers 62. In all other aspects, handle 58 is similar to handle means 18 as previously discussed.

In operation, the device 100 of FIG. 5 is employed in like fashion to the device 10 as shown in FIG. 4. It is seen that the user can avoid the necessity of stooping down or crouching to pick up debris for placement in the film bag, since the debris can either be swept in with a brush or broom or in the case of twigs and the like, gently eased in by use of the foot.

We claim:

1. A novel trash bag holder adapted to retain a trash bag in open position for the collection of debris without the necessity of bending or lifting, which comprises in combination:

a frame formed of relatively slender pieces joined to surround an empty space, and adapted to house a trash bag inserted through said space and spread over said frame for mounting, a handle means engageable with said frame to retain said mounted bag on said frame, said handle means comprising a handle portion having two frame receiving sections descending downwardly therefrom, said frame receiving section adapted to engage said frame, wherein each frame receiving section has a groove therein slidingly engageable with a piece of said frame.

2. The bag holder of claim 1 wherein said frame is rectangular.

3. The bag holder of claim 1 wherein said frame is triangular.

4. The bag holder of claim 2 wherein said handle portion has a finger opening therein.

5. The handle of claim 2 wherein the frame is a one piece extraction.

6. A trash bag holder adapted to retain a trash bag in open position for the collection of debris without the necessity of bending or lifting which comprises in combination:

a frame formed of relatively slender pieces joined to surround an empty space, and adapted to have a trash bag inserted through said space and spread over said frame for mounting said frame being generally rectangular;

a handle means comprising a handle portion having a top surface and a bottom surface, and having a finger slot therein, a pair of spaced frame receivers descending downwardly from the underside of said handle portion, each of said frame receivers having an inwardly facing groove, said handle means' grooves adapted to engage said frame and the bag mounted on said frame.

7. The bag holder of claim 6 wherein the underside of said handle portion between said frame receivers are grooved.

* * * * *